US005282633A

United States Patent [19]

Boylan et al.

[11] Patent Number: 5,282,633

[45] Date of Patent: Feb. 1, 1994

[54] METHOD OF PLAYING A CARD GAME

[75] Inventors: Eugene B. Boylan, Zephyr Cove; Anthony J. Delise, State Line; Robert F. Koerner, Gardnerville, all of Nev.

[73] Assignee: BET Technology, Inc., Carson City, Nev.

[21] Appl. No.: 932,237

[22] Filed: Aug. 19, 1992

Related U.S. Application Data

[63] Continuation-in-part of Ser. No. 764,306, Sep. 23, 1991, Pat. No. 5,141,234.

[51] Int. Cl.[5] ..... A63F 1/00

[52] U.S. Cl. ..... 273/306; 273/292; 273/303; 273/274; 273/85 CP

[58] Field of Search ..... 273/292, 306, 303-305, 273/274, 309, 85 CP

[56] References Cited

U.S. PATENT DOCUMENTS

| | | | |
|---|---|---|---|
| 3,998,462 | 12/1976 | Goott | 273/274 |
| 4,222,572 | 9/1980 | Baker | 273/306 |
| 4,480,840 | 11/1984 | Chang | 273/292 |
| 4,591,162 | 5/1986 | Fakhoury | 273/303 |
| 4,651,997 | 3/1987 | Wood | 273/274 |
| 4,659,087 | 4/1987 | Shen et al. | 273/274 |
| 4,836,553 | 6/1989 | Suttle et al. | 273/292 |
| 5,037,108 | 8/1991 | Banasky | 273/242 |
| 5,072,946 | 12/1991 | Miller | 273/292 |
| 5,098,107 | 3/1992 | Boylan et al. | 273/292 |

OTHER PUBLICATIONS

Walter B. Gibson; "Hoyle's Modern Encyclopedia of Card Games", *Rules of all the basic games and popular variations;* pp. 20-23 and pp. 302-305.

*Primary Examiner*—Benjamin H. Layno

*Attorney, Agent, or Firm*—Larson & Taylor

[57] ABSTRACT

A method for playing a wagering or bidding game whose outcome is determined by randomly received symbols is provided. Initially, symbols such as cards having a numerical value of one, two, or three as well as a designation as one of two suits are supplied. In addition, there are also no value cards having no suit. A plurality of players are each dealt a hand using the cards or other symbols and then players in turn make increasing bids on a suit total until the bid of a last player is called by the next player to bid. This suit total is the total of added numerical values of the cards of the selected suit in the hands of all of the players. The no value cards are also preferably used and bids can also be made on the number of these cards in the hands of the players. Alternately, the symbols are displayed on a video display screen as part of an electronic game device.

10 Claims, 2 Drawing Sheets

METHOD OF PLAYING A CARD GAME

RELATED APPLICATIONS

This application is a continuation-in-part of U.S. patent application Ser. No. 07/764,306 filed Sept. 23, 1991 and now U.S. Pat. No. 5,141,234.

FIELD OF THE INVENTION

The present invention relates generally to chance games using symbols in which a wager is made or a score is otherwise kept, and more particularly to such games where the symbols have numerical values and are of one of two suits so that the winning hand is determined by a net or suit total.

BACKGROUND OF THE INVENTION

Games in which wagers are made based on the outcome of randomly (chance) generated or selected symbols have wide appeal. Such games include various card games as well as other games where there are randomly generated or selected symbols. In order to increase interest in wagering games, many different games have been proposed besides the usual well-known games such as poker, blackjack (twenty-one), and baccarat.

For example, in the game of "Seven and a Half", which is similar to blackjack, only the ace to the seven cards and face cards are used, with the ace to seven cards having their nominal value (1 for the ace and 2–7 for the others) and face cards having a value of ½. The object of the game is achieve a total of 7½ without going over (in a manner similar to the play of blackjack).

A simple card game has also been proposed in U.S. Pat. No. 4,222,572 (Baker). The card deck used includes high and low red and black cards, and high cards of a third color. The cards do not have any numerical value, but only the high or low designation for simplicity. Wagers are made on such things as the next individual card to be turned up or combinations of the cards in a hand to be dealt.

In U.S. Pat. No. 4,591,162 (Fakhoury), a deck of cards for playing multiple lottery games is disclosed. For example, the cards can be numbered from 1 to 10 and come in four separate suits. The cards can be used in the "LOTTO" type of game.

Another wagering game using regular playing cards is disclosed in U.S. Pat. No. 4,651,997 (Wood). In the disclosed game, the players make wagers on whether a third card will be of a rank between two originally dealt cards.

A multi-suit card game is disclosed in U.S. Pat. No. 4,480,840 (Chang) which is used for many different games. The cards are preferably a Chinese Poker deck which may be used for calculating the Chinese perpetual calendar, and which may also be composed into various disclosed poker games.

SUMMARY OF THE INVENTION

In accordance with the present invention, a method of playing a wagering game whose outcome is determined by randomly received symbols is provided. Initially, symbols having a numerical value as well as a designation as one of two suits are supplied. A wager by at least one player is then made on the attaining of a net total of a hand of that player of received symbols. The net total of a hand is equal to a gross total of added numerical values of the symbols of one suit less a gross total of added numerical values of the symbols of the other suit. A hand of the symbols is then dealt to the player and the net total of the hand is determined. A settlement of the wager based on the hand determination is then made.

In a preferred embodiment, there are at least two players and the dealing step includes the dealing of a hand to each of the players. Then, the net total of each hand dealt is determined and the net totals of the hands are compared to determine which net total is closest to a predetermined winning total without exceeding the winning total. Where the players include a house against which each other player wagers, the wagers are settled by the house.

In the preferred embodiment, the supplied symbols are cards and the dealing step includes the dealing of a certain number of the cards to each player. In this embodiment, the cards have numerical values of one, two or three and the predetermined winning total compared against is seven. In addition, there are also no value cards having no suit which are dealt. The play in this embodiment includes the initial wagering of an ante, the dealing of three cards to each player, the making of an additional wager, and the presenting to each player of an optional hit card. If desired, the paying of a further ante to a dealer of the cards by each other player who receives a hit card can also be required.

In one preferred embodiment, the wagering step also includes the step of making an additional wager by a receiving player that the receiving player will receive at least two of the first three cards of a selected suit. Optionally, the wagering step can also include the step of making an additional wager by a receiving player that the receiving player net total will be equal to that of the dealer.

In another preferred embodiment, the symbols are displayed on a video display screen as part of an electronic game device which includes a registering means for registering a wager in the game device and a settling means for settling in the registering means of net credits won or lost in the playing of the game in the game device. Preferably, the symbols are representations of cards on the video display screen, and additional wagers on receiving at least two of the first three cards of a selected suit can also be made.

An apparatus for playing the wagering games discussed above is also provided. This apparatus includes a plurality of symbols having a numerical value of one to three as well as a designation as one of only two suits and a display means for displaying the symbols as the symbols are randomly selected. This display means includes a wagering means for wagering on a net total of the symbols received in a play of the game, and a suit wagering means for wagering that two of a first three cards received in a hand are of a selected suit. Preferably, zero value symbols are also provided which do not have a suit designation, and the symbols are playing cards. A tie wagering means for wagering that the net total is equal to that of a dealer also playing the game can also be provided.

In accordance with the present invention, another method of playing a bidding game is provided whose outcome is determined by randomly received symbols (as with the method and apparatus discussed above, with the symbols having a numerical value as well as a designation as one of at least two suits). A hand of the symbols is initially dealt to each of a plurality of players. A first player then makes a bid on a suit total of received symbols of a selected one of the suits in all of the hands of all of the players. This suit total is equal to a total of added numerical values of the symbols of the selected suit. Next, a succeeding player following the first bidding player either (a) makes a new bid on a su::t total which is greater than the bid of the first player of a selected one of the suits, or (b) calls the bid made by the first player.

This bidding process is then repeated in turn for all of the players and continues among the players as necessary until the succeeding player calls the (last) bid of the last bidding player. When a bid is called, a determination is then made of the suit total of the suit of the last bid made by the last bidding player. A loser is next determined between the succeeding calling player and the last bidding player. The calling player loses if the suit total is equal to or greater than the last bid and the last bidding player loses if the suit total is less than the last bid.

In a preferred embodiment, the supplied symbols are cards and the dealing step includes the dealing of a certain number of the cards to each player. In addition, the cards preferably have numerical values of one, two or three, and no value cards having no suit are then dealt with the numerical value cards.

In accordance with the method of playing a bidding game as discussed above, preferably a number of deals (as needed) are made to determine an ultimate winner. To do this, the dealing step includes the step of initially dealing to each player of a set number of symbols. Thereafter, the method further includes the step of successively dealing a new hand to each of the players after each loser determining step with each player receiving one less symbol in each succeeding hand for each time that player is a loser. Thus, the ultimate winner of the game is the player who remains after all of the other players are no longer receiving a symbol in a succeeding deal.

In order to keep track of which players are supposed to receive how many symbols, the method also includes the initial steps of giving each player a plurality of tokens corresponding to the set number of symbols at the beginning of the game (i.e., before or with the first deal) and displaying of the tokens of each player. The successively dealing ste then includes the removing of one token from the display of a player each time that the player is a loser.

As with the other method discussed above, the present method of a bidding game also preferably includes the supplying of no value symbols having no suit which are dealt with the numerical value symbols. The bidding step and subsequent bidding step then further include the bidding of a minimum number of no value symbols and the subsequent bidding of one of a greater number of no value symbols or a new suit total greater than the last suit total bid.

It is an object of the present invention to provide a chance game which generates increased interest and participation.

It is also an object of the present invention to provide a chance game which is simple and easily understood.

Other features and advantages of the present invention are stated in or apparent from detailed descriptions of presently preferred embodiments of the invention found hereinbelow.

DETAILED DESCRIPTION OF THE PREFERRED EMBODIMENTS

Figure 1:
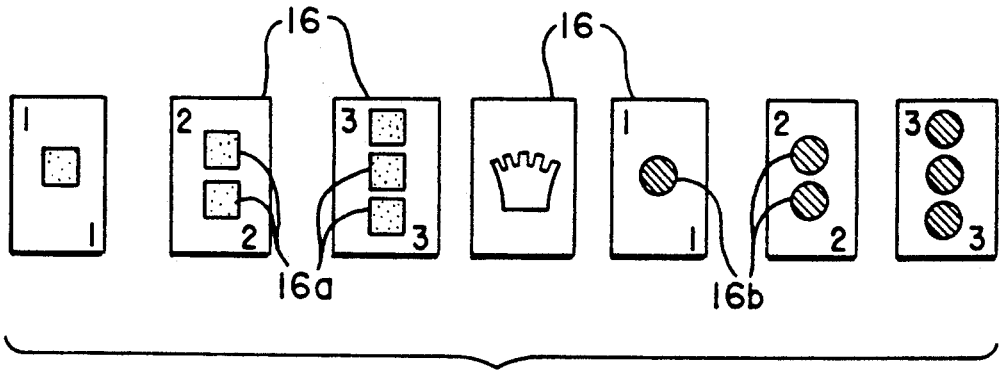
FIG. 1 depicts the different cards used in preferred embodiments of the present invention.

With reference now to the drawings in which like numerals represent like elements, a playing system 10 is depicted in FIG. 1 for playing the chance wagerinq game according to a first preferred embodiment of the present invention. Playing system 10 includes a display means 12 for this wagering game. It should initially be appreciated that playing system 10 is adaptable for use either as a casino operator's live action table or as a home playing board. Thus, display means 12 could either be a top surface of a table and thus serve as a permanent structure for a live action game or as a board, sheet, or velcro elements for use in a portable home game. As such, it will be appreciated that display means 12 in all cases includes a surface 14 which is viewable by the various participants (player(s), dealer and/or house).

Playing system 10 is designed to provide for the playing of a unique game. This game includes a plurality of sets of playing cards 16, with one complete set depicted in FIG. 1. As shown in FIG. 1, there are value cards with numerical values 1, 2, and 3, which are designated both by numerals and by counters 16*a* and 16*b*. There are only two suits of these numerical value cards, which are identified both by different counters 16*a* and 16*b* as well as by coloring counters 16*a* and 16*b* differently, such as purple and gold. However, in the drawing, one suit is designated with stipples while the other is designated by slashes for clarity. Preferably each set of cards 16 also includes a no value card, shown in FIG. 1 with a crown indicia and not of either of the two suits of the numerical value cards (as shown by the lack of either stippling or slashes, for clarity). A plurality of sets, preferably at least seven in number, are combined into a deck and mixed thoroughly. For convenience, display means 12 includes a shoe 18 in which cards 16 are retained before being dealt to the participants. With such a shoe, a number of decks are mixed together so that as the cards are dealt each card is randomly generated.

In order to wager on the outcome of a deal of a game, display means 12 includes a usual wagering means in the form of a surface 20 marked with the indicia "ANTE" or otherwise indicated or understood. To place a usual wager, a wagering token 22 (such as a chip, money, coin, bill, paper or other item chosen to have a value) is simply placed on surface 20 at the beginning of each deal of the game. Typically, a player will be required to make an ante wager or to give up his place at display means 12.

Display means 12 also includes a tie wagering means 24 and a suit wagering means 26 with suitable identifying indicia provided. In order to make such wagers prior to the commencement of each deal (i.e., before a new hand is dealt), the player simply places one or more wagering tokens 22 in the appropriate wagering means 24 and/or 26.

As playing system 10 is designed for a game having a dealer and from 1 to 5 players, each player plays against the dealer. The dealer is therefore supplied with a settling means 28 which in this embodiment takes the form of a bank 30 of wagering tokens 22 (which are conveniently of various denominations as desired). Thus, if the player loses, the player settles or pays by the loss of his wagering tokens 22 placed on surface 20, typically by the collection of such tokens 22 by the dealer and placing these tokens 22 into bank 30. Conversely, if the player wins against the dealer, the dealer simply settles or pays the player from tokens in bank 30. Similarly, wagers using tie wagering means 24 and/or suit wagering means 26 are also settled.

Figure 2:
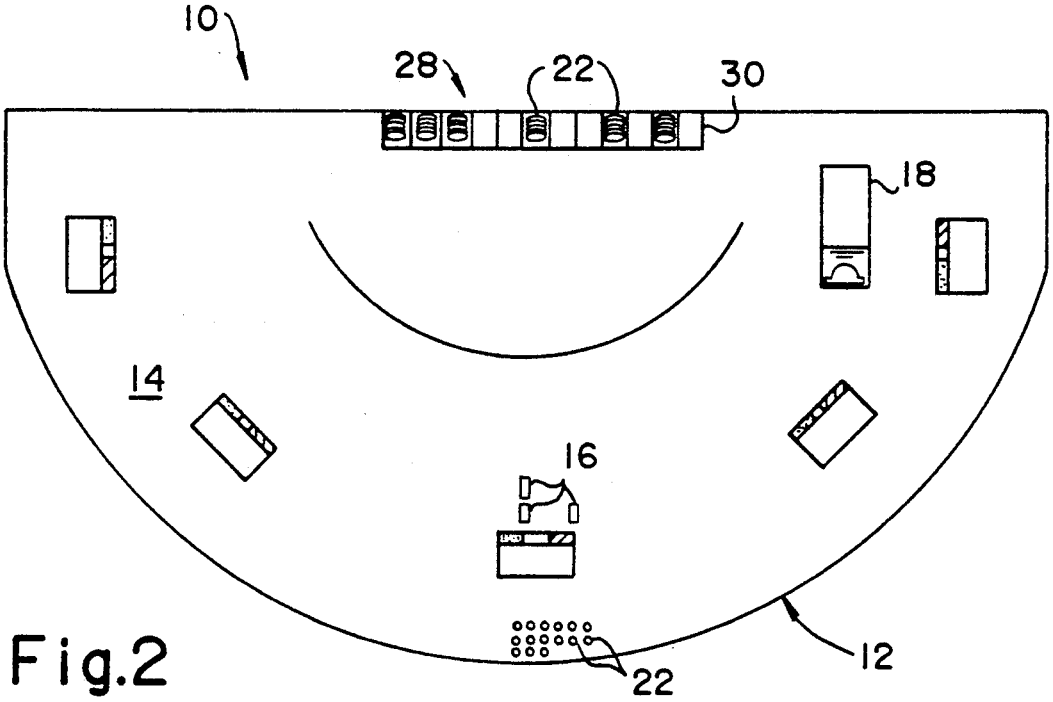
FIG. 2 is a schematic representation of a display surface for the wagering game of the present invention.
Figure 3:
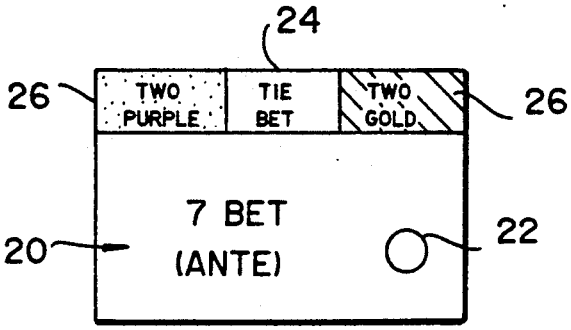
FIG. 3 is an enlarged view of the wagering indicia shown in FIG. 2.

It should be appreciated that it is easiest to play the game according to the present invention where the suits of the received cards are displayed together. Therefore, surface 20 has the two suit wagering means 26 separated from one another by tie wagering means 24. As shown in FIG. 2, cards 16 of one suit are then lined up forward (of the receiving player's surface 20) of the appropriated suit wagering means 26. Where a no value (suitless) card is received, this card is then simply lined up forward of tie wagering means 24.

With the use of playing system 10, it should be appreciated that a number of different versions of wagering games of the present invention are possible. Some of these are discussed subsequently.

Version 1

In a first version of a wagering game according to the present invention, each player other than the dealer presents an initial wager or ante by placing a wagering token 22 on surface 20. Each player is playing against the dealer (though the game could also be played to have a single winner between all of the players if no house dealer is desired in a home version). If desired, the players can also make a wager using tie wagering means 24 and/or a wager using suit wagering means 26. After all wagers are made, the dealer deals the cards in turn with each player receiving three cards face up and the dealer receiving two cards face up and one face down.

The overall object of this game is to have a net total of the cards which is higher than the dealer but without exceeding a predetermined value, in this version seven. The net total is figured by adding the gross total of the numerical values of one suit and subtracting therefrom the gross total of the numerical values of the second suit. The zero value cards do not affect the net total, and the net total is always considered positive (subtract the suit with the higher value from the suit with the lower value).

After determining his net total, the player can consider the two face up cards of the dealer. The player is then offered an additional hit card, which the player can accept or decline depending on the net value of his current hand. If desired, the dealer can charge a fee to obtain the additional hit card. After all of the players have been offered the hit card, the dealer reveals his down card and determines his net total. If the dealer net total is 5, 6, or 7, the dealer "stands" and settles all usual bets. If the dealer total is 1–4 or 8–9, the dealer takes one additional card and then settles all usual wagers.

If one or more players made a suit wagering bet, winners are determined after the first three cards are dealt. To win a suit wager, the player must receive at least two of the first three cards of the designated suit (purple or gold). If the wager is not won, the dealer simply collects the token wagered in the suit wagering means. If the wager is won, the dealer pays the player according to a set ratio or payoff.

If one or more players made a tie wagering bet, winners are determined at the same time that the usual wagers are settled. The placing of a tie bet is a bet that the player and the dealer will have net totals which are equal. As the dealer wins all ties, the placing of a tie bet is simply a way to guard against a loss when this circumstance occurs. Preferably, the player winning a tie bet gets paid at some designated ratio or payoff. For convenience, the tie bet and the ante can be the same, so that the winner of the tie bet gets to keep his ante (which would otherwise have been lost as ties are won by the dealer).

In a home version of this game, the players would simply take turns being the dealer. When acting as a dealer, the player would not be eligible to make tie or suit bets—but would have to pay them off or collect the losing bets as appropriate.

In another home version where there is no house dealer, the deal circulates and each player receives two cards face up and one card face down.

Version 2

In a second version of a wagering game of the present invention, the usual wagering is made to a "pot" in the center of the table and the outcome is ultimately determined in the same manner. However, this game is played more like poker and the winner is determined between all of the players including the dealer. In this version, the suit wagering means and the tie wagering means are not used. Thus, after two cards are dealt face down, each player including the dealer looks at their cards and turns one card face up. The player with the highest exposed hand can option to make a bet or pass the bet option to the next player. Each player must then match the bet or fold the hand, and each player can chose in turn to raise the bet. The maximum number of raises per turn will be determined by the "house" or otherwise predetermined.

After the first round of betting is completed, the dealer deals each player still playing a third card face down. Each player then looks at the card and turns one of the two face down cards in his hand face up. The betting steps outlined above are then repeated.

After the second round of bets, the dealer gives each remaining player the option of receiving one optional card. The same betting sequence is then repeated. When all bets have been placed, the players reveal their remaining face down cards. The winner is determined by the highest net total as described in Version 1, and the winner then wins the pot of bets. In case of a tie, the winners simply split the pot.

Version 3

In this version, the play proceeds essentially the same as in Version 2 described above. However, in this version, only a single optional fourth card is dealt face up in the middle of the table. Each player can then decide whether or not to use this optional card.

Version 4

In this version, a plurality of additional cards having no value are added to the deck. These additional cards are used for additional side bets in a manner as described in copending U.S. patent application Serial No. 667,227 filed Mar. 11, 1991 and herein incorporated by reference.

It should also be appreciated that various chance generating mechanisms are possible to play the versions mentioned above and other versions. Such mechanisms would include balls coming to rest on a surface divided to designate cards or other such symbols in a manner similar to "poker ball" or the like and as also described in greater detail in the above-identified application.

Figure 4:
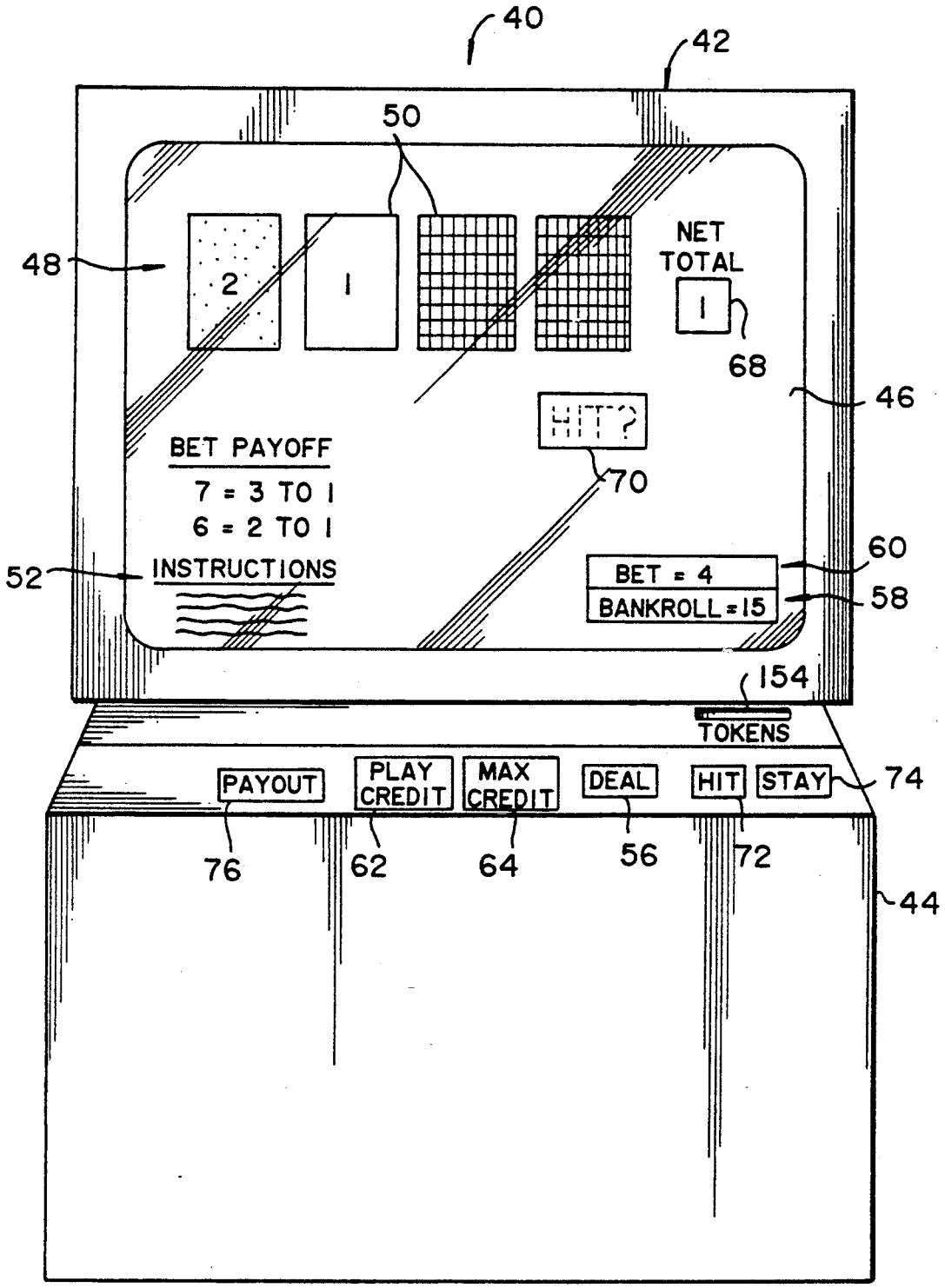
FIG. 4 is a front plan view of an electronic wagering game of the present invention.

Depicted in FIG. 4 is a playing system 40 which includes a display means 42. Display means 42 is an electronic game device 44 having a video display screen 46. In playing system 40, the object of the game is to obtain a net total shown in a hand display 48 of predetermined values which have predetermined payoffs. Thus, the symbols used are simply representations 50 of the cards 16 described above.

In order to play a hand with game device 44, the following steps are taken. Initially, in an attract mode after a hand has been played, the words "INSERT COIN" appears in an instruction area 52. This is an invitation to feed from one to five tokens into game device 44 through suitable wager receiving means 54. After five tokens are received in wager receiving means 54, the game will automatically start. If it is desired to wager less than five tokens, then after the desired number of tokens are inserted in wager receiving means 54, deal button 56 is pressed to start the game.

Alternatively, if credits are already present in a suitable registering means including an indicia 58 on display screen 46 (which shows a "bankroll" credit of 15), one or more credits is transferred to bet indicia 60 by depressing play credit button 62. As shown in FIG. 4 in bet indicia 60, a bet of four credits has been made. For convenience, if it is desired to wager the maximum number of credits, five in this example, max credit button 64 is simply depressed to transfer five credits from bankroll indica 58 and this also automatically starts the game. It should be appreciated that indicia 58 thus serves to indicate the number of credits left, and serves as an indication of winning wagers which are credited or registered to this bankroll.

After a hand of playing system 40 is initiated by placing a bet and pressing deal button 56 (if necessary), the first three representations 50 of the backs of the cards in hand display 48 are turned over one after another to a card representation (in FIG. 4, two of the first three cards have been turned over). Conveniently, this proceeds from left to right automatically for the first three cards. The net total is then indicated by an indicia 68.

After the three cards have been dealt, the player then has the opportunity to be dealt one additional card. This is conveniently indicated in the instruction area 70 by the word "HIT?" (shown in phantom in FIG. 4, as this will only be seen at the appropriate time on display screen 46). If it is desired to receive the fourth card, a hit button 72 is depressed. If it is not desired to receive a fourth card, a "STAY" button 74 is depressed. When either hit button 72 or stay button 74 is depressed, the hand in display screen is set and game device 44 determines the net value of the hand as displayed in net total indicia 68. A payoff as indicated by suitable indicia appearing in instruction area 70 is then made, either by removing the bet total from bet indicia 60 or providing credits to bankroll indicia 58.

If the player desires to play again, a bet is then made to start an new hand. Otherwise, the player presses a payout button 76 and game device 44 makes a suitable payout (if any) such as tokens or a receipt.

While a number of versions of a wagering game have been described, it will be appreciated that other variations and modifications are possible. Thus, higher value cards and a higher predetermined net total for winning would be possible. In addition, many other playing systems would possible besides those described.

In an alternative method of playing a chance game according to the present invention, the same cards (or other symbols) as described above are used. However, the game is more of a calling type of game, and thus is typically played with a number of people (preferably at least three). In accordance with the method of this calling game, a hand is initially dealt to the plurality of players. The first player, typically designated to one side of the dealer, then makes a bid on a suit total of received cards of a selected suit (of that player's choice) in all of the hands of all of the players. This suit total is equal to a total of added numerical values of the cards of the selected suit.

After the initial bid, succeeding players (according to the course of play, typically in a direction about a table from the initial bidder) follow a last bid (i.e., the bid of the first player, or thereafter the last player to bid) with one of the following: (a) a subsequent bid on a new suit total which is greater than the last bid in a suit selected by the succeeding player, or (b) a call of the last bid made by the last player. Obviously, so long as a subsequent bid is made, play continues around the table with each succeeding player given the choice of making a subsequent bid or a call.

However, when the last bid is called by a succeeding player, play then stops and the suit total of the suit of the last bid made is determined. A loser of the deal is then determined between the succeeding calling player and the last bidding player. The calling player loses if the suit total is equal to or greater than the last bid and the last bidding player loses if the suit total is less than the last bid.

As with the wagering games above, no value cards are also preferably used, although the game can be played as indicated above without no value cards or with them where they are simply considered to have no value. However, where the no value cards are used, the game is preferably played where each player is also offered the choice of making a bid of a minimum number of no value cards in the hands of all of the players. For a game where each player (initially, as discussed below) receives four cards and there are four players, the minimum bid for no value cards could be three. Thereafter, each player would have the option of bidding either a higher number of a suit total, or a higher number of no value cards, or of calling the bid of the last player. Obviously, the loser of a call of a no value card bid is determined in the same manner as for a suit total bid.

While a loser is determined for each deal, it is also desired to determine an ultimate winner for the game. In accordance with the method of this bidding game, this is accomplished by initially dealing each player a set number of the cards, such as four as noted above. Thereafter, in each deal each player receives one less card in his hand for each time that player has been a loser. It will thus be appreciated that eventually there will only be one player left who is still entitled to receive a card, and at that time that player is declared the ultimate winner of the game.

In order to make it easier to keep track of how many cards each player is supposed to receive each deal, all players display a number of tokens or the like at the beginning of the game which corresponds to the number of cards to be initially received (i.e., for four initial cards, each player will display four tokens). These tokens are displayed in some suitable manner, as by being placed on a table in front of the player. Thereafter, each time a player is a loser, that player loses one token. It is therefore easy to deal a new round with the correct number of cards for the hand of each player being easily determined by the number of tokens which the players have in front of them. Obviously, if a player has no tokens remaining, that player is out of the game and receives no cards.

If it is desired to make the calling game a gambling type of game, it will be appreciated that the tokens can be purchased or represent a value. Then, at the end the ultimate winner can receive the value of all tokens. Alternately, each player can be required to provide an ante for the tokens and the ultimate winner would receive the antes of all players, or some other value or prize as determined by a house.

While the present invention has been described with respect to preferred embodiments thereof, it will be appreciated by those of ordinary skill in the art that variations and modifications can be effected within the scope and spirit of the invention.

What is claimed is:

1. A method of playing a bidding game whose outcome is determined by randomly received symbols comprising the steps of:

supplying of symbols having a numerical value as well as a designation as one of at least two suits;

dealing a hand of the symbols to a plurality of players;

bidding by a first player of a bid on a suit total of received symbols of a selected one of the suits in all of the hands of all of the players, where the suit total is equal to a total of added numerical values of the symbols of the selected suit;

by a succeeding player following a last bidding player, one of (a) subsequently bidding of a new bid on a suit total, which is greater than a last bid of the last player, of a selected one of the suits, or (b) calling of the last bid made by the last player;

repeating the subsequent bidding step as necessary in turns by the players until the succeeding player calls the last bid of the last bidding player;

determining of the suit total of the suit of the last bid made by the last bidding player; and determining of a loser between the succeeding calling player and the last bidding player where the calling player loses if the suit total is equal to or greater than the last bid and the last bidding player loses if the suit total is less than the last bid.

2. A method of playing a bidding game as claimed in claim 1 wherein the supplied symbols are cards; and wherein said dealing step includes the dealing of a certain number of the cards to each player.

3. A method of playing a bidding game as claimed in claim 2 wherein the supplying step supplies cards having numerical values of one, two or three.

4. A method of playing a bidding game as claimed in claim 3 wherein the supplying step also supplies no value cards having no suit which are then dealt with the numerical value cards.

5. A method of playing a bidding game as claimed in claim 1 wherein said dealing step includes the step of initially dealing to each player of a set number of symbols; and further including the step of successively dealing a new hand to each of the players after each loser determining step with each player receiving one less symbol in each succeeding hand for each time that player is a loser such that an ultimate winner of the game is the player who remains after all of the other players are no longer receiving a symbol in a succeeding deal.

6. A method of playing a bidding game as claimed in claim 5 and further including the initial steps of: giving each player a plurality of tokens corresponding to the set number of symbols at the beginning of the game and displaying of the tokens by each player; and wherein said successively dealing step includes removing of one token from the displays of the players each time that the player is a loser.

7. A method of playing a bidding game as claimed in claim 6 wherein the supplying step also supplies no value symbols having no suit which are then dealt with the numerical value symbols.

8. A method of playing a bidding game as claimed in claim 7 wherein said bidding step and subsequent bidding step further include one of a bidding of a minimum number of no value symbols and the subsequent bidding of one of a greater number of no value symbols.

9. A method of playing a bidding game as claimed in claim 1 wherein the supplying step also supplies no value symbols having no suit which are then dealt with the numerical value symbols.

10. A method of playing a bidding game as claimed in claim 9 wherein said bidding step and subsequent bidding step further include one of a bidding of a minimum number of no value symbols and the subsequent bidding of one of a greater number of no value symbols.

* * * * *